US007283641B2

(12) United States Patent
Rolla

(10) Patent No.: US 7,283,641 B2
(45) Date of Patent: Oct. 16, 2007

(54) EXTENSIVE MOBILITY HELMET HEADSET AND HELMET WHICH INCLUDES SAID HEADSET

(76) Inventor: José María Rolla, Perón 1219-piso 3° "14", Buenos Aires (AR) 1038

( * ) Notice: Subject to any disclaimer, the term of this patent is extended or adjusted under 35 U.S.C. 154(b) by 400 days.

(21) Appl. No.: 10/833,432

(22) Filed: Apr. 28, 2004

(65) Prior Publication Data

US 2004/0218776 A1 Nov. 4, 2004

(30) Foreign Application Priority Data

May 2, 2003 (AR) ..... P030101531

(51) Int. Cl.
*H04R 25/00* (2006.01)

(52) U.S. Cl. ..... 381/376; 381/370; 381/374

(58) Field of Classification Search ..... 381/370, 381/371, 374, 376, 377, 378, 379, 383, 309; 2/209, 423, 183; 128/857, 864, 866; 181/129, 181/137

See application file for complete search history.

(56) References Cited

U.S. PATENT DOCUMENTS

| | | | | |
|---|---|---|---|---|
| 3,197,785 | A | 8/1965 | Simpson et al. | |
| 3,461,463 | A * | 8/1969 | Beguin | 2/423 |
| 4,069,512 | A | 1/1978 | Palmaer | |
| 4,944,361 | A | 7/1990 | Lindgren et al. | |
| 5,185,807 | A * | 2/1993 | Bergin et al. | 381/378 |
| 6,654,966 | B2 * | 12/2003 | Rolla | 2/209 |

* cited by examiner

*Primary Examiner*—Huyen Le
(74) *Attorney, Agent, or Firm*—Amin Hallihan LLC

(57) ABSTRACT

A mobility helmet headset includes a hinged headband and a setting support to secure the headband onto the helmet, an intermediary arm and a mounting support of an earcup. The mounting support is hinged to the earcup and the intermediary arm is hinged to the mounting support. The hinged headband may be folded and unfolded between the user's ear position and the side wall of the helmet within a single plane. The helmet which includes the present headset includes a pair of headsets on it side walls.

16 Claims, 7 Drawing Sheets

FIG. 3
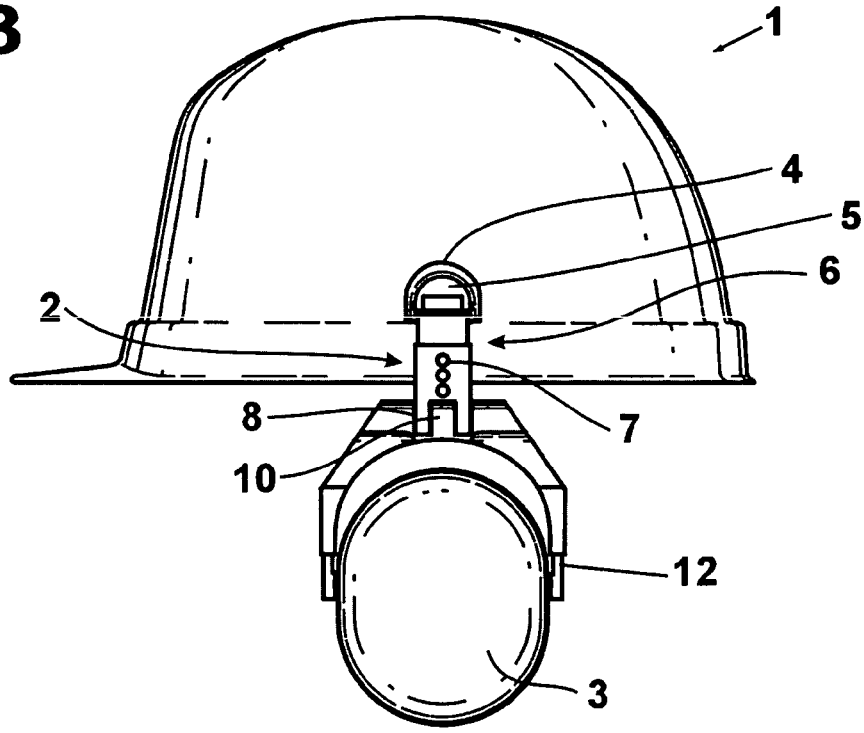
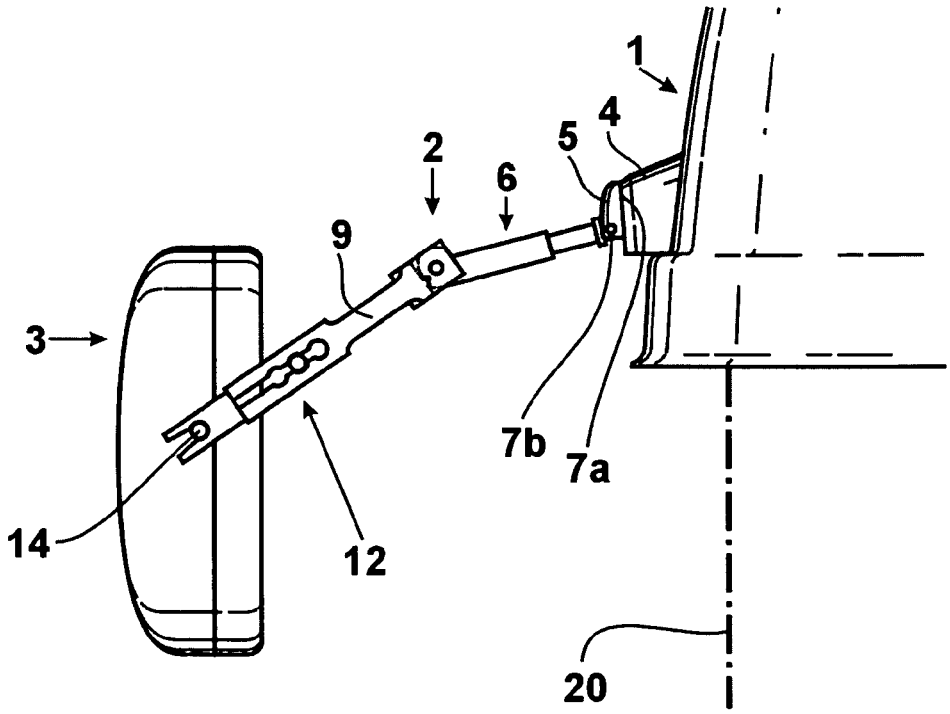
FIG. 4

FIG. 5a
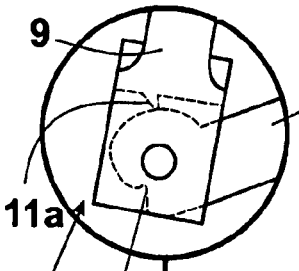
FIG. 5
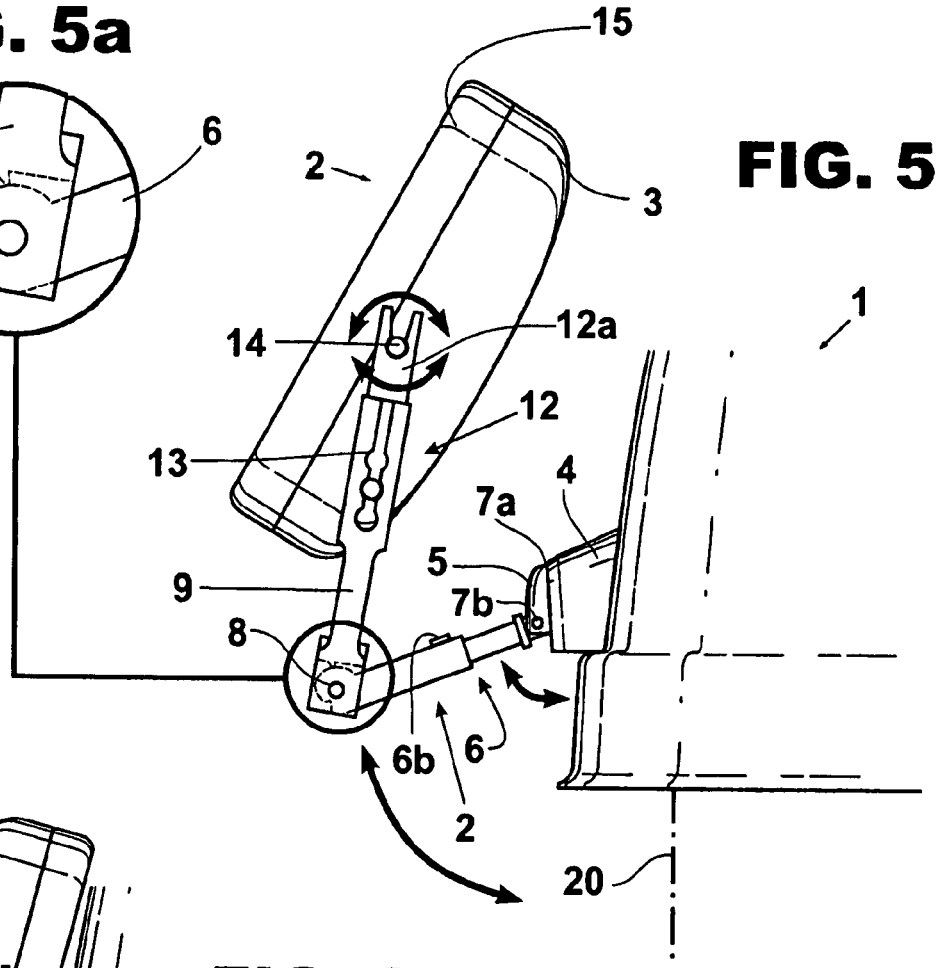
FIG. 6
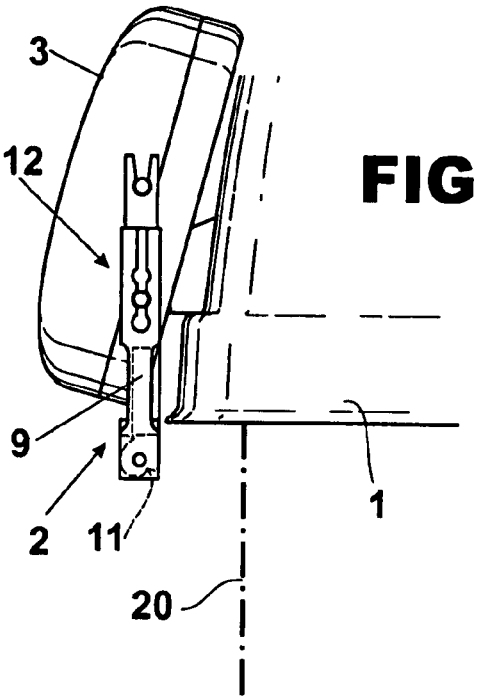
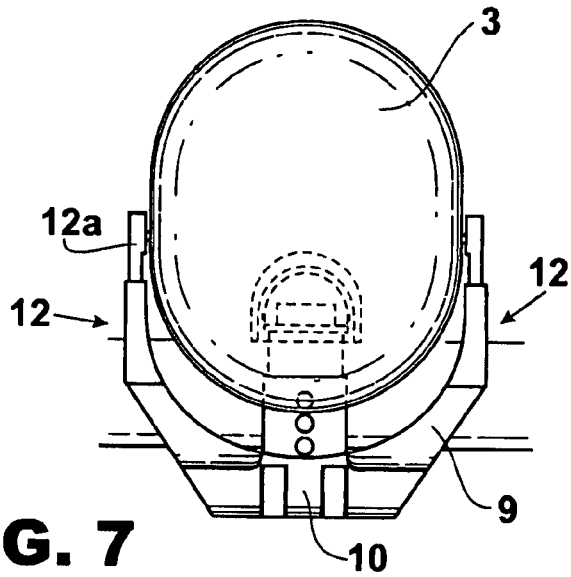
FIG. 7

EXTENSIVE MOBILITY HELMET HEADSET AND HELMET WHICH INCLUDES SAID HEADSET

I—BACKGROUND OF THE INVENTION

1. Field of Invention

The present invention relates to security means for workers' heads and to headsets applicable to users' ears.

More particularly, it relates to an extensive mobility helmet headset and a helmet which includes said headset which can be properly applied to the user's ear or can be fully folded against the side wall of the helmet.

2. Description of Prior Art

U.S. Pat. Nos. 3,197,785 and 4,944,361 disclose headsets for helmets which, despite having certain mobility particularly towards the bottom part of the mouth of the helmet, lack extensive mobility so as to be folded against the side walls of the helmet.

U.S. Pat. No. 4,069,512 discloses a helmet the headsets of which are remarkable due to their rotation capacity between the bottom part and the top part of said helmet. However, it lacks folding and unfolding capacity between the top and bottom end positions.

In short, numerous headsets applicable to security helmets, which can be positionally adjusted, are known. However, most conventional headsets have mounting and/or adjustment means which greatly limit their mobility.

In general, movements are short and are used for partial turns or to keep the earcups away from the user's ear.

II—SUMMARY OF THE INVENTION

The present invention consists in an extensive mobility helmet headset which comprises a hinged headband (2) composed of a setting support (4) to secure it onto the helmet (1), an intermediary arm (6) and a mounting support (9) of an earcup (3); the mounting support (9) is hinged (14) with the earcup (3) and the intermediary arm (6) is hinged (7*a*)(7*b*) with the mounting support; the hinged headband (2) can be folded and unfolded between the user's ear position (20) and the side wall of the helmet (1).

Objects and Advantages

An object of the present headset is that it can be both firmly applied to the user's ears and be fully folded against the side walls of the helmet when not in use.

Its mobility capacity allows for intermediate positions between end positions, so that the earcups can be momentarily away from the user's ears, without folding the headset completely against the side walls of the helmet.

An advantage is that, in said fully folded position, the headsets are laid in such a way that they do not interfere with the balance of the helmet on the user's head.

Another advantage of the present headset is that it not only provides great protection but also allows the user to go to different rooms with different levels of security without having to remove the helmet. Therefore, it combines practicality and comfort with effective protection in security areas.

Furthermore, the different means of mobility, position regulation and adjustment of the present headset provide it with a mobility capacity and a range of movements not present in any of the known headsets.

III—DESCRIPTION OF THE DRAWINGS

For the sake of clarity and understanding of the object of the invention, the present device is illustrated in different figures in which it has been represented in one of the preferred embodiments, by way of example and not by limitation:

FIG. 3 is a side view of the helmet with the applied headset.

FIG. 4 is a side view of the headset in its partially unfolded position.

FIG. 5 is a side view of the headset in its partially folded position.

FIG. 5*a* is a detail of the hinge between the intermediary arm and the earcup support.

FIG. 6 is a side view of the headset in its fully folded position against the side wall of the helmet.

FIG. 7 is a front view of the headset in its fully folded position against the side wall of the helmet.

Figure 8:
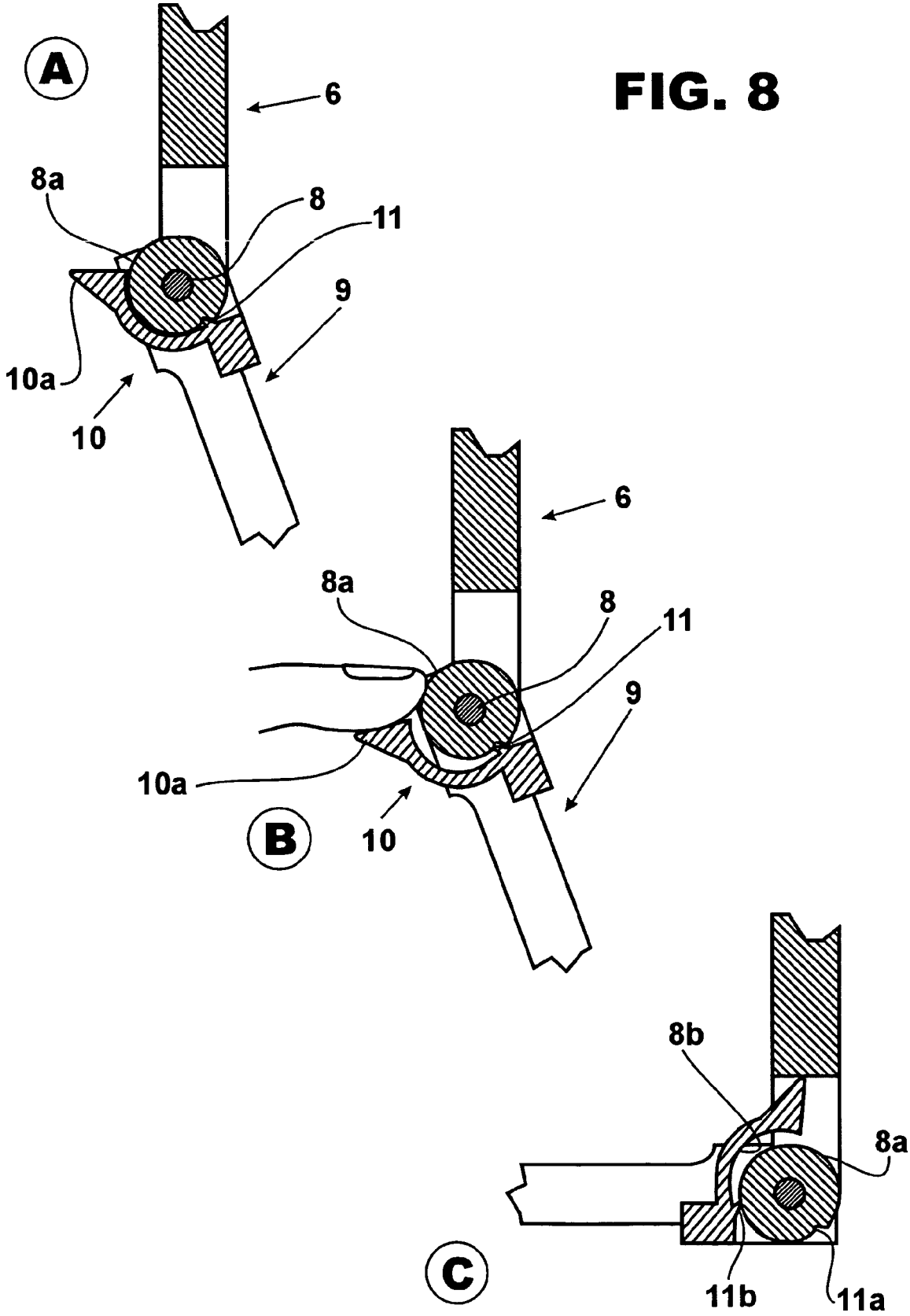

FIG. 8 is a perspective view of the hinge with ledge-recess position setting means.

Figure 9:
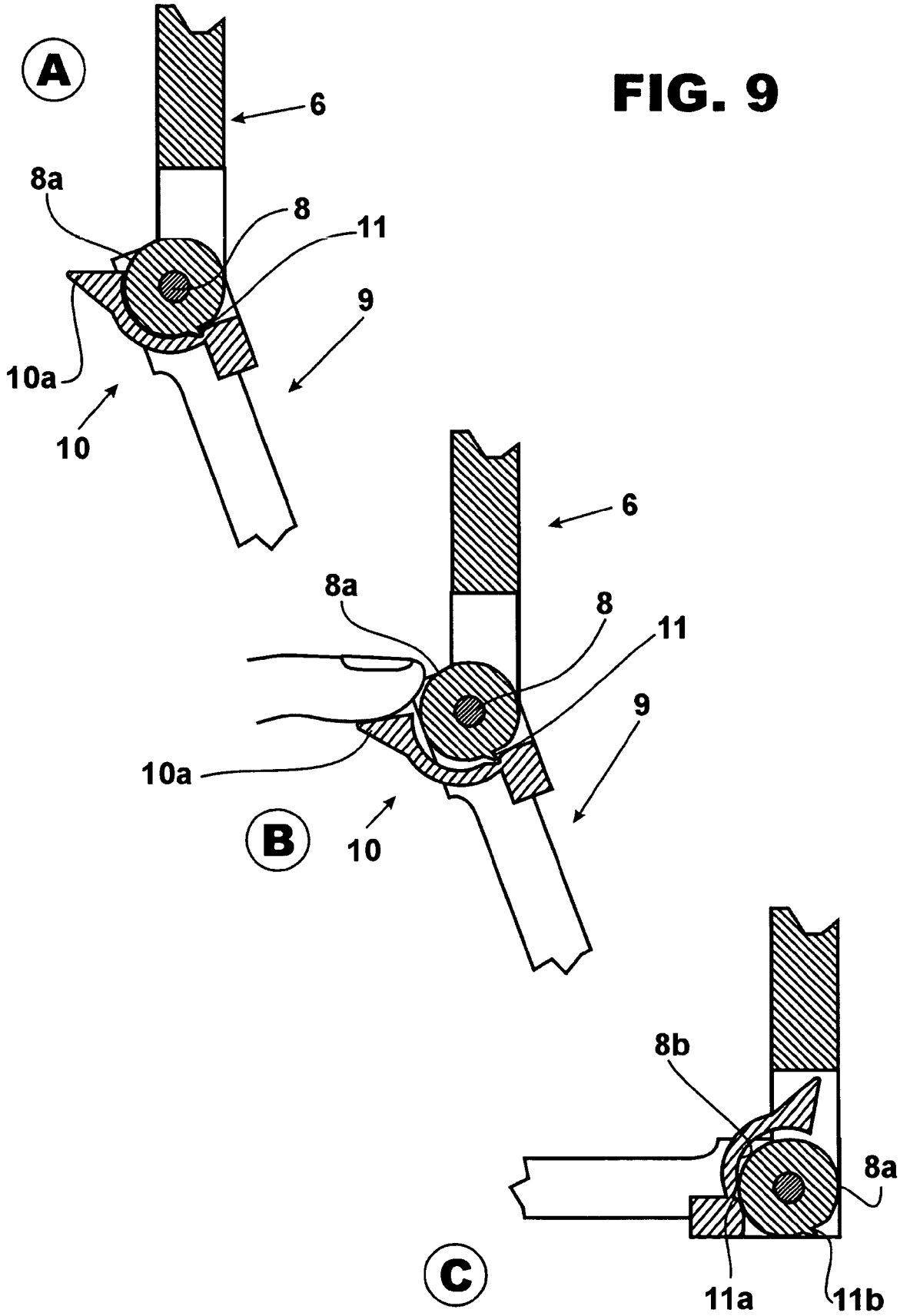

FIG. 9 is a perspective view of the hinge with ledge-recess position setting means.

Figure 10:
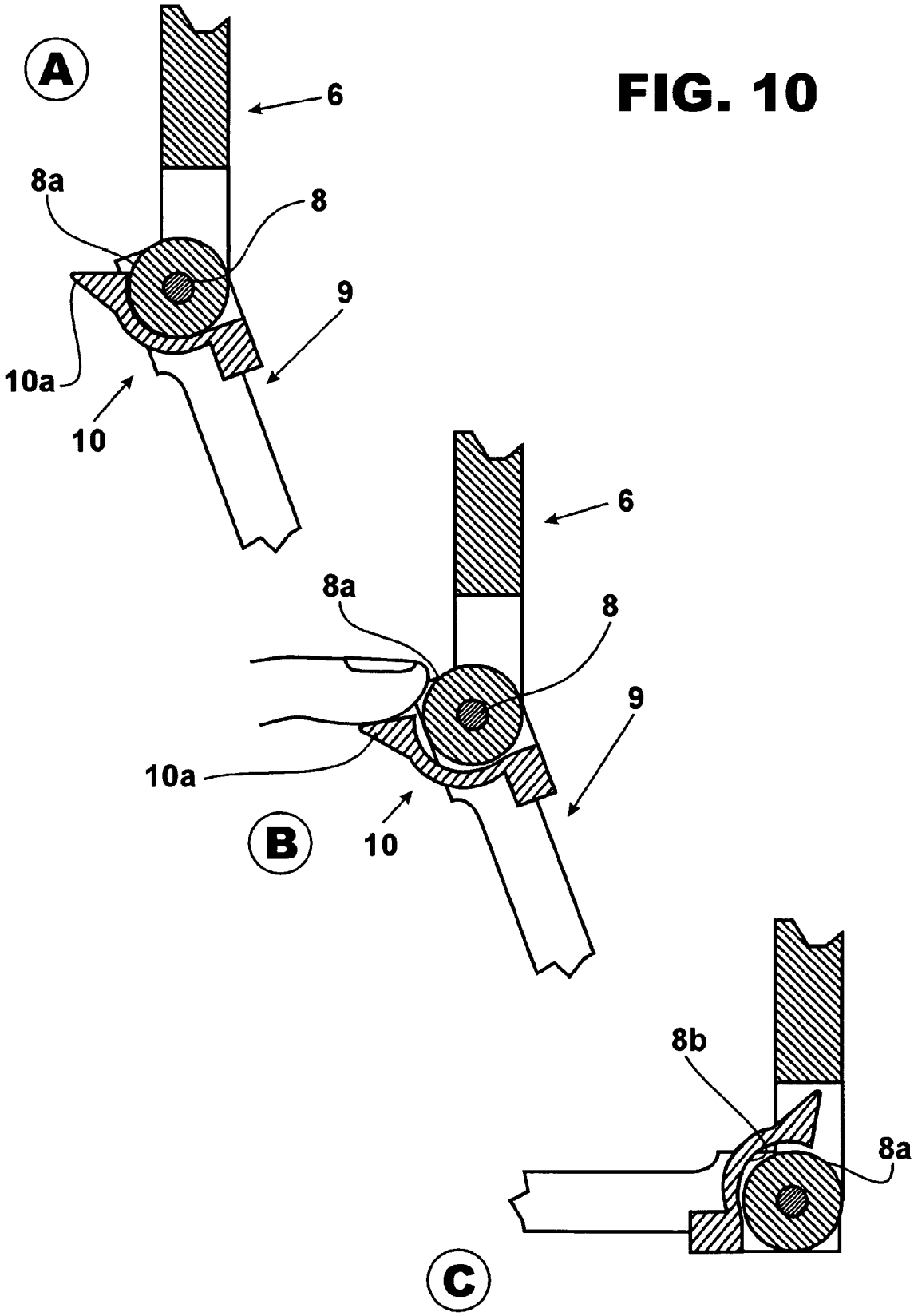

FIG. 10 is a perspective view of the hinge with frictional contact position setting means.

Figure 11:
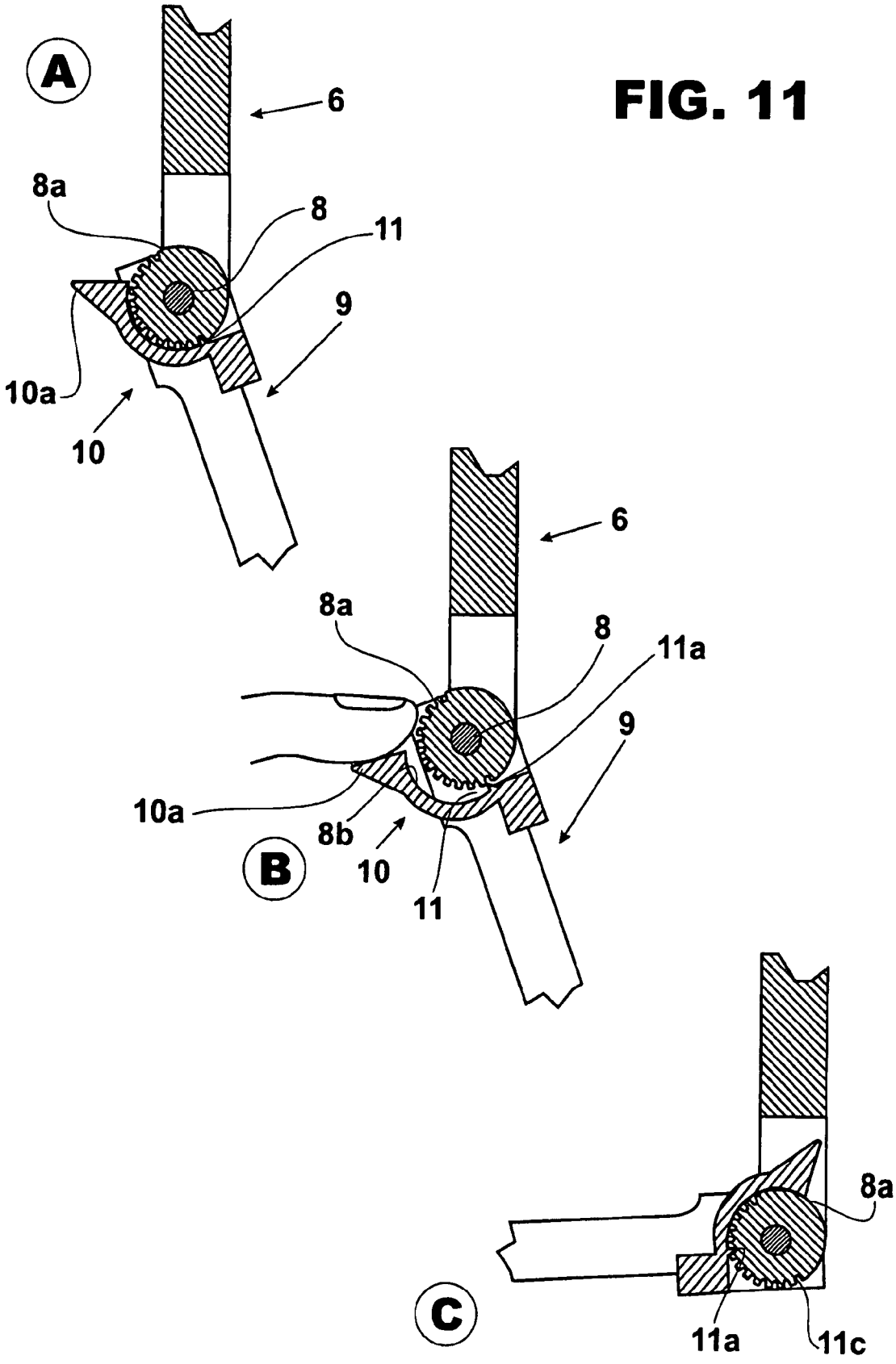

FIG. 11 is a perspective view with position setting means with ledges engaging a plurality of recesses.

In the different figures, like reference numerals designate the same or corresponding parts, and the sets of several elements have been signalled with letters.

REFERENCE NUMERALS IN DRAWINGS (1) Helmet.
(2) Hinged headband.
(3) Earcup.
(4) Setting support.
(5) Rotary movable piece [in the setting support (4)].
(5*a*) Hinge axis of the intermediary arm.
(5*b*) Force-driven cam.
(6) Intermediary arm.
(6*a*) First position-adjustment means.
(6*b*) First position-setting means.
(7*a*) First hinge.
(7*b*) Second hinge.
(8) Third hinge.
(8*a*) Sliding track of the third hinge (8).
(8*b*) Contact face with the track (8*a*).
(9) Mounting support of the earcup (3).
(10) Hinge area.
(10*a*) Third hinge (8*a*) releasing clamp.
(11) Second position-setting means.
(11*a*) Position setting ledge.
(11*b*) Position setting recess.
(11*c*) Plurality of recesses [engagement type].
(12) Mounting support (9) ends.
(12*a*) Second position-regulation means.
(13) Third position-setting means.
(14) Fourth hinge.
(15) Padded frames.
(20) User's ear position.

IV—DETAILED DESCRIPTION

Figure 1:
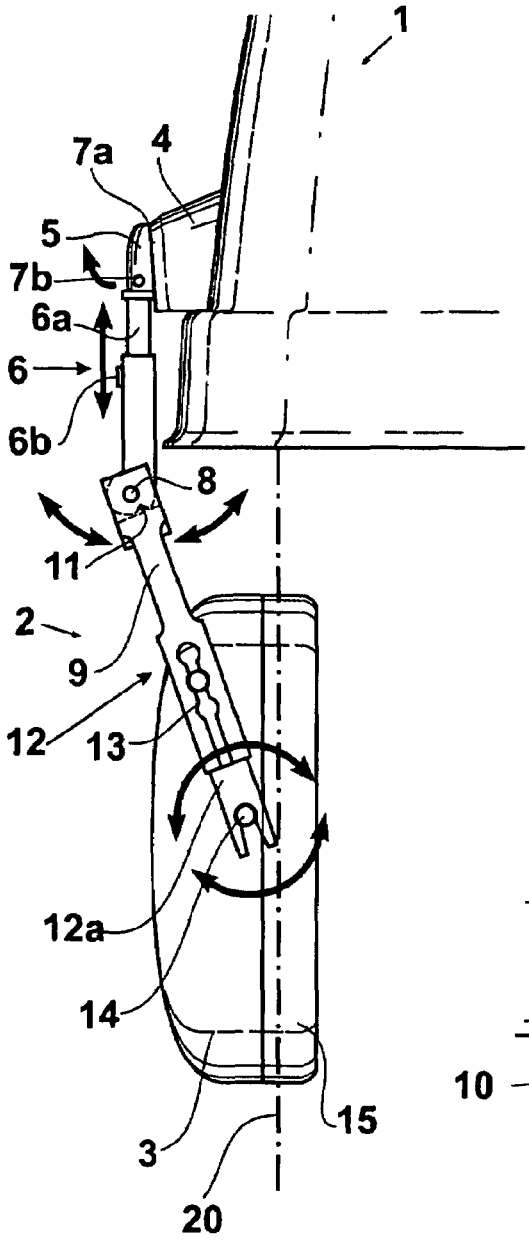
FIG. 1 is a side view of the headset in the position in which it is applied to a user's ears.

In general terms, as shown in FIG. 1, the present invention consists of an extensive mobility helmet headset which comprises a hinged headband (2) composed of a setting support (4) to secure it onto the helmet (1), an intermediary arm (6) and a mounting support (9) of an earcup (3); the mounting support (9) being hinged (14) with the earcup (3) and the intermediary arm (6) being hinged (7*a*)(7*b*) with the mounting support (9); the hinged headband (2) can be folded and unfolded between the user's ear position (20) and the side wall of the helmet (1).

More particularly, the present headset can be used as a protective means against noise, cold or to listen to sound signals. It can be fixedly or removably mounted onto a helmet (1) like a security helmet, so that the earcups (3) can move between the side walls of said helmet (1) and the normal position (20) of the user's ear below the mouth of the helmet.

Figure 2:
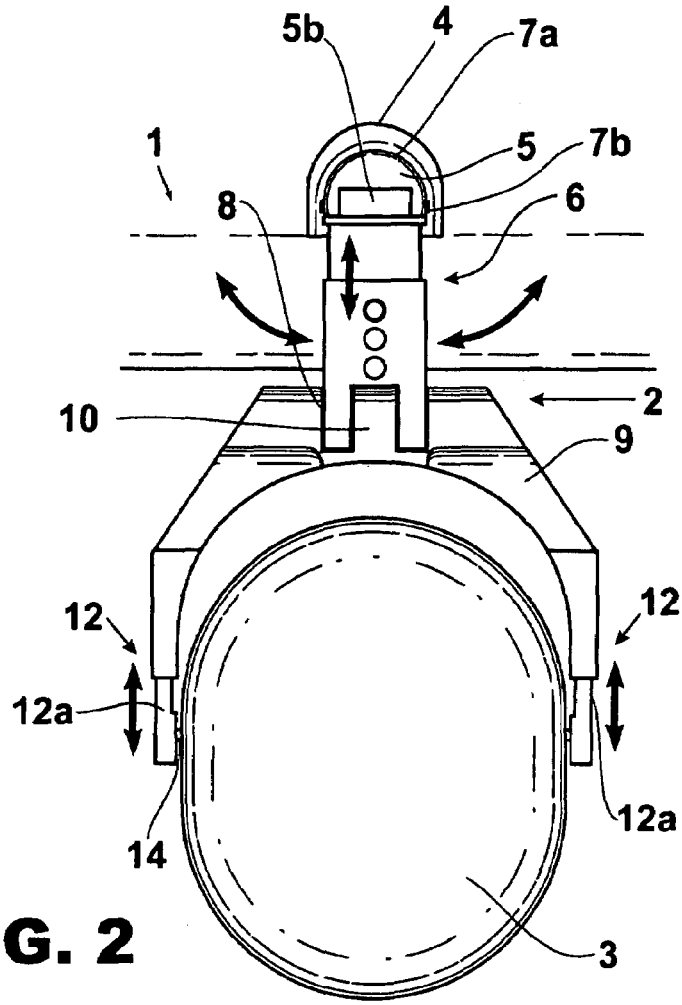
FIG. 2 is a front view of the headset.

As shown in FIG. 2, the present headset has a hinged headband (2) which comprises a setting support (4) that secures it onto the helmet (1), an intermediary arm (6) and a mounting support (9) of the earcup (3) which is applied to the user's ear.

The setting support (4) is fixed to the side wall of the helmet (1). As shown in FIGS. 3 and 4, the intermediary arm (6) is doubly hinged (7*a*)(7*b*) with said setting support (4), so that the hinging capacity is exercised in transverse planes. The double hinge is provided by a first hinge (7*a*) between the setting support (4) and a rotary movable piece (5) and a second hinge (7*b*) between said movable piece (5) and the intermediary arm (6).

The intermediary arm (6) has a force-drive cam (5*b*) in the second hinge (7*b*), as shown in FIG. 2.

FIG. 2 shows said intermediary arm (6) provided with a first position-regulation means (6*a*) and a first position-setting means (6*b*), which is one possible embodiment, although other equivalent means could be used.

Between the intermediary arm (6) and the mounting support (9) there is a third hinge (8) which, in the hinge area (10), has a second position-setting means (11).

As shown in Figs 5*a*, 8 and 9, the position setting means (11) can be a ledge (11*a*) and recess (11*b*) which can be indistinctly on the sliding track (8*a*) or on the contact face (8*b*) of the third hinge (8). FIG. 10 shows that the position setting means (11) is provided by simple friction between the sliding track (8*a*) and the contact face (8*b*). It could also be provided by the formation of a cam or by multiple ledges (11*c*) of the engagement type, as shown in FIG. 11.

In all these cases, there is a releasing clamp (10*a*).

Besides, the mounting support (9) of the earcup (3) forms a pair of ends (12) each of which is provided with a second position-regulation means (12*a*) and a third position-setting means (13), which are illustrated in one of their possible embodiments.

The connection with the earcup (3) is between said ends (12) and the fourth hinges (14).

Operation:

The first (7*a*), second (7*b*), third (8) and fourth (14) hinges of the hinged headband (2) provide it with extensive mobility. Therefore it can be folded and unfolded as a means of carrying the earcup (3), as shown in FIGS. 1, 4, 5 and 6.

On the one hand, the hinged headband (2) can be folded from the user's ear position (20) towards the side wall of the helmet (1).

On the other hand, the hinged headband (2) can be unfolded from the side wall of the helmet (1) towards the user's ear position (20).

The second position-setting means (11) can be at the third hinge (8) in such a way that, when active, the mounting support (9) keeps the earcup (3) normally pressed against the user's ear (20).

To release the third hinge (8), the releasing clamp (10*a*) must be drive, as shown in FIG. 8.

Helmet:

The helmet (1), which includes the present extensive mobility headset, is a hollow structure provided with a mouth for the user's head. To both sides of said mouth are the side walls.

On said side walls there is a set of headsets. These headsets are mounted by means of respective setting supports (4).

Each setting support (4) has setting means so that they are fixed to the respective side wall of the helmet (1).

What is claimed is:

1. A mobility helmet headset which is a protective member against noise, cold or to listen to sound signals, comprises a headset which, is structurally arranged to be mounted onto a security helmet, to permit the earcups to move between the side walls of the helmet and the user's ear positioned below the helmet, including in combination:

a) a setting support that secures the headset onto the security helmet;

b) with said headset having an earcup engageable with the user's ear;

c) with said headset having a hinged headband which connects said earcup with said setting support;

d) wherein said hinged headband comprises said setting support that secures the headset onto the helmet, a mounting support for the earcup and an intermediary arm positioned between said mounting support and hinged to said setting support;

e) wherein said mounting support is hinged to the earcup;

f) the said intermediary arm is hinged with said mounting support; and g) wherein said hinged headband may be folded and unfolded within a single plane as a means of positioning the earcup over the user's ear and against the side wall of the helmet.

2. The mobility helmet headset in accordance with claim 1; wherein said hinged headband, may be folded between the user's ear position and the side wall of the helmet and, on the other hand, may be unfolded between said side wall of the helmet and said user's ear position.

3. The mobility helmet headset in accordance with claim 1; wherein said mounting support of the earcup is hinged with the intermediary arm in such a way that its hinging course goes through a predetermined position in which position-setting means of said mounting support are active within said single plane.

4. The mobility helmet headset in accordance with claim 3; wherein said position setting means are active in a position in which the mounting support keeps the earcup normally pressed, at least, against the user's ear position.

5. The mobility helmet headset in accordance with claim 3; wherein said position setting means are formed in the hinge between the intermediary arm and the mounting support of the earcup.

6. The mobility helmet headset in accordance with claim 1; wherein said hinge between the intermediary arm and the setting support that secures it onto the helmet is force-driven due to the formation of a cam.

7. The mobility helmet headset in accordance with claim 1; wherein said intermediary arm is doubly hinged with the setting support so that its hinging capacity is exercised in transverse planes.

8. The mobility helmet headset in accordance with claim 1; wherein there are position regulation means in the intermediary arm.

9. The mobility helmet headset in accordance with claim 1; wherein there are position regulation means in the intermediary arm provided with position setting means.

10. The mobility helmet headset in accordance with claim 1; wherein there are position regulation means in the mounting support of the earcup.

11. The mobility helmet headset in accordance with claim 1; wherein there are position regulation means in the mounting support of the earcup provided with position setting means.

12. The mobility helmet headset in accordance with claim 1; wherein said hinge between the mounting support of the earcup and the intermediary arm is force-driven.

13. The mobility helmet headset in accordance with claim 1; wherein said hinge is force-driven due to the friction between the different parts of the hinge.

14. The mobility helmet headset in accordance with claim 1; wherein said hinge between the mounting support of the earcup and the intermediary arm comprises a releasing clamp of the hinge set.

15. The mobility helmet headset in accordance with claim 1; wherein said hinge between the mounting support of the earcup and the intermediary arm comprises position setting means.

16. The mobility helmet headset in accordance with claim 15; wherein said position setting means consist in a ledge and a recess.

* * * * *